United States Patent [19]

Morel et al.

[11] Patent Number: 4,901,062

[45] Date of Patent: Feb. 13, 1990

[54] RASTER SCAN DIGITAL DISPLAY SYSTEM

[75] Inventors: Jeanne E. Morel; Darwin P. Rackley; Stephen W. Trynosky; William A. Wall, all of Boca Raton, Fla.

[73] Assignee: International Business Machines, Armonk, N.Y.

[21] Appl. No.: 282,919

[22] Filed: Dec. 6, 1988

Related U.S. Application Data

[63] Continuation of Ser. No. 918,249, Oct. 14, 1986, abandoned.

[51] Int. Cl.[4] ..... G09G 1/02; G09G 1/28

[52] U.S. Cl. ..... 340/703; 340/799

[58] Field of Search ..... 340/703, 701, 702, 799, 340/798, 750, 731, 721, 728, 814; 358/283; 364/521

[56] References Cited

U.S. PATENT DOCUMENTS

| | | | |
|---|---|---|---|
| Re. 31,200 | 4/1983 | Sukonick et al. | 340/799 |
| 3,533,942 | 8/1985 | Gall et al. | 358/78 |
| 3,821,730 | 6/1974 | Carey et al. | 340/799 |
| 4,121,283 | 10/1978 | Walker | 340/703 |
| 4,232,311 | 11/1980 | Agneta | 340/703 |
| 4,250,502 | 2/1981 | Klauck et al. | 340/750 |
| 4,342,029 | 7/1982 | Hofmanis et al. | 340/703 |
| 4,439,762 | 3/1984 | Van Vliet et al. | 340/799 |
| 4,574,279 | 3/1986 | Roberts | 340/731 |
| 4,591,842 | 5/1986 | Clarke et al. | 340/703 |
| 4,727,362 | 2/1988 | Rackley etal. | 340/703 |

OTHER PUBLICATIONS

Lu, "Sharpening Your Video Display", High Technology, Jul. 1986, p. 54.

IBM, "IBM Monochrome Display", Personal Computer Hardware Reference Library, Apr. 1984.

IBM, "IBM Color Display", Personal Computer Hardware Reference Library, Apr. 1984.

Chandler et al., "Sixteen-Color Graphics", PC Tech Journal, Aug. 1986, pp. 159-171.

Raghavan et al, "Powerful Support Chips Simplify Graphics Design", Electronic Design, Aug. 21, 1986, pp. 123-126.

Teja, "Improved Monitors Outshine EGA Graphics", Mini-Micro Systems, Nov. 1986, pp. 65-75.

Knight, "High Resolution PC Graphics Card Emulates Standard Modes", New Electronics, Jun. 23, 1987, p. 44.

*Primary Examiner*—Alvin Oberley

*Attorney, Agent, or Firm*—Winfield James Brown

[57] ABSTRACT

An all points addressable raster scan graphics display system is operable in two modes. In the first mode, data is extracted from a refresh store, serialized, modified, and applied to a display device at a first frequency. In the second mode, data is extracted from the refresh store, serialized and partially modified at said first frequency, but it is then further modified and passed to the display device at an even sub harmonic, for example half, of the first frequency. The further modification includes concatenation of successive groups of display data bits. Accordingly, with the raster scan device operating at a constant scan velocity, the first mode provides a high picture element definition but relatively low color definition display, and the second mode provides a display with an even submultiple, for example half, the picture element definition but considerably greater color definition.

10 Claims, 4 Drawing Sheets

RASTER SCAN DIGITAL DISPLAY SYSTEM

TECHNICAL FIELD

The present invention relates to digital display systems and in particular to such systems which employ a raster scan display device.

BACKGROUND TO THE INVENTION

Digital display systems for use with computer systems are well known. In many graphics systems employing raster scan display devices, the all points addressable or bit plane system is employed. In this system, data is laid out in a refresh store such that when it is read out for display, successive data groups from the store relate directly to successive picture elements on the display. One of the early descriptions of such a system is found in an article entitled "Computer Graphics In Color" by Peter B. Denes, which appeared in the Bell Laboratories Record, May 1976 at pages 139 through 146. Many current micro computer systems employ the all points addressable system to generate graphics displays. One example is the Personal Computer produced by International Business Machines Corporation, when incorporating a Color/Graphics adapter card or an Enhanced Graphics adapter card. Most of the known systems can be switched to provide different display definitions, including different numbers of picture elements per raster frame, different numbers of display lines, and different numbers of available colors per picture element. None of the prior systems, to Applicants' knowledge, have employed an arrangement switchable between a first mode in which data is extracted from a refresh store at one frequency and transmitted to the display at the same frequency and a second mode in which the data is extracted from the store at this frequency but transmitted to the delay device at a frequency which is an even dividend, for example half, of the extraction frequency.

BRIEF SUMMARY OF THE INVENTION

A digital display system according to the invention includes a refresh store for storing digital data defining, display picture elements, and means for converting data read from the refresh store into picture element signal groups for the display. The system includes switching means for switching between first and second modes. In the first mode, data is read from the store, and applied to the display device at a first frequency. In the second mode, data is read from the store and initially converted at said first frequency, but is finally converted and applied to the display device at an nth sub harmonic (for example half) of said first frequency. In the second mode successive groups of data derived from the store are combined to form the display drive signals.

DETAILED DESCRIPTION OF AN EMBODIMENT OF THE INVENTION

Figure 1:
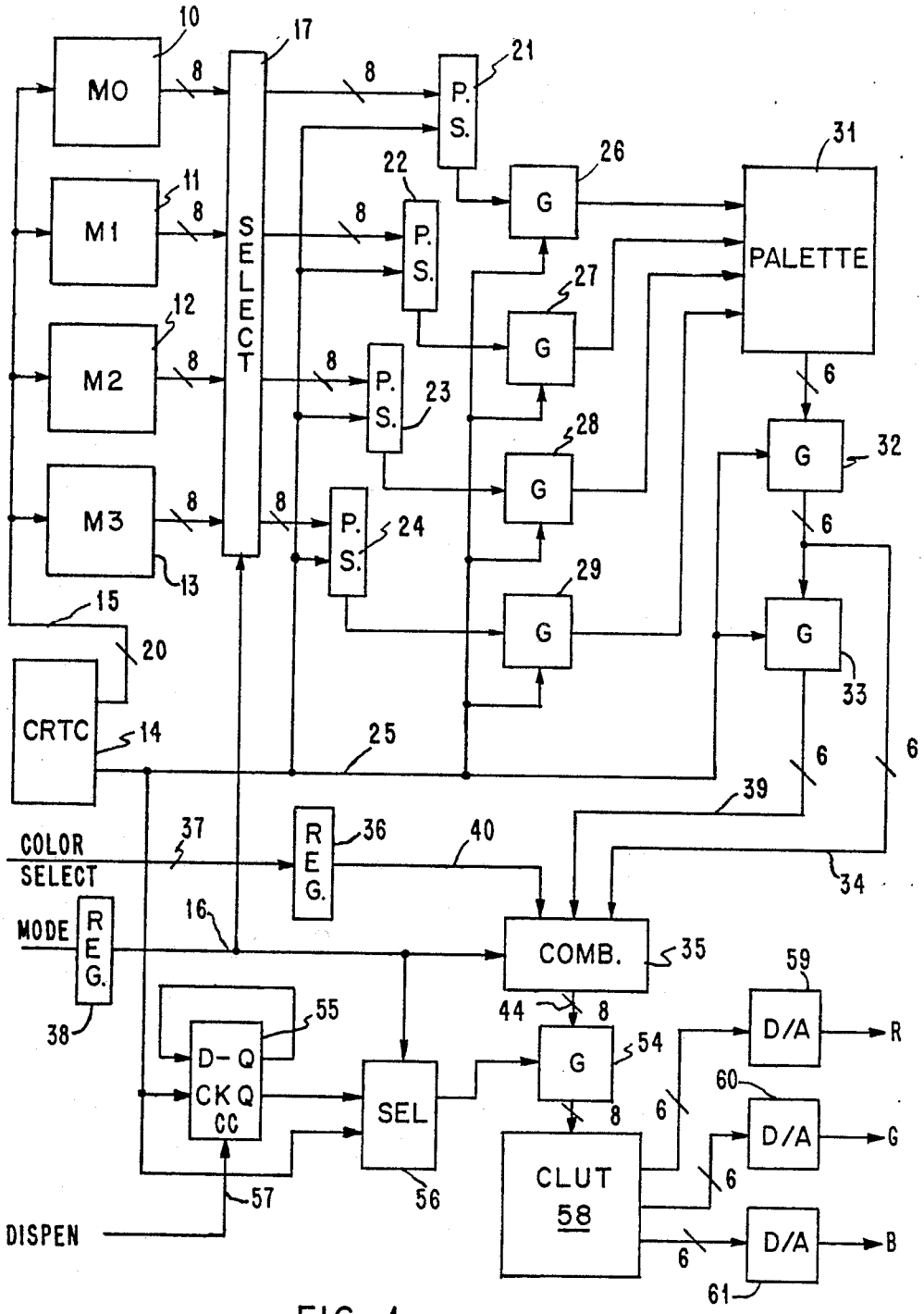
FIG. 1 is a block diagram of a digital display adapter for coupling a central processing unit to a raster scan display device.

FIG. 1 is a block diagram of a digital display system embodying the invention. The system has input lines coupled to a central processing unit (not shown) and output lines coupled to a cathode ray tube display device (not shown). The system includes a refresh store comprising four memory planes 10–13 for storing, respectively, data representing different color components of signals to be displayed. Thus, for example plane M0 (10) stores red components, plane M1 (11), green components, plane M2 (12), blue components and plane M3 (13), intensity components. Data is stored in the refresh store in all points addressable (APA) configuration. In this configuration, bytes of data are located in the planes at locations corresponding to the positions of picture elements on the cathode ray tube display. Thus, for example, at the start of a CRT scan, four selected bytes are read simultaneously from identical locations in each of the planes of the refresh store, one byte from each plane. These bytes are normally used to define the color and/or intensity of the first eight picture elements of the display. Subsequently, the bytes at an address immediately following the initially read address are read to define the color and/or intensity of the next eight picture elements of the display. This process continues until all the picture elements have been defined and displayed. Depending on the definition of the display and the size of the refresh store, the data for a display frame may either fill the refresh store or be stored in a portion of the addressable locations therein. In the former case, the initial address for a display frame is the first address of each plane of the refresh store. In the latter case, the initial address for a display frame may be chosen at a selected address within the refresh store. By changing this initial address from frame to frame, panning and animation functions may be performed. The sequential refresh store addresses for reading the display data from this store are generated by a cathode ray tube controller (CRTC) system 14 and applied to the refresh store through 20 address lines 15. CRTC system 14 may be of the type MC6845 manufactured by Motorola Inc., and may be controlled in a known manner by input signals on lines (not shown), including clock and control lines, from the central processor unit. For simplicity, direct connections between the refresh memory and central processor unit have not been shown. These connections would, of course, include data bus and address bus connections, to address lines 15 through a conventional multiplexer system or the like. These connections permit the central processor unit to access the refresh store to insert and update data to be displayed.

The present invention is directed to an arrangement for employing the data in the refresh store to provide different display resolution signals, both with respect to the numbers of picture elements in a display frame and the number of available colors for each picture element. As an example, three switchable resolutions will be described, the first two providing a 640×200 picture element display with 16 or 64 colors per element respectively, and a third providing a 320×200 picture element display with 256 colors per element.

First we describe operation in a first mode generating a 640×200 picture element display with 16 colors per pixel. The register 38 receives and stores mode control signals form the central processing unit and outputs mode control signals on the conductors 16. In this mode, select circuit 17 has no effect on signals passing through it. Accordingly, for each access of the refresh store, a group of four bytes of data, one byte from each refresh store memory planes 10–13 is fed unchanged to shift registers 21 through 24. Shift registers 21 through 24 are clocked together by timing signals on a line 25 from CRTC 14 to serialize the received bytes. The serial outputs from the shift registers are clocked through synchronizing gates 26 through 29 to provide parallel 4 bit inputs to a palette register system 31. The palette register system 16 and the following elements convert the data groups derived from the store into picture element drive signal groups to actually drive the display as will now be described. This register system comprises sixteen registers loadable from the central processor unit (through data and control lines, not shown) and selected by the 4 bit inputs. Each register stores 6 bits. The 6 bit outputs of a selected one of the registers are applied to a 6 bit gate 32 and are clocked from this gate, by clock signals on line 25, to a further 6 bit gate 33. The outputs of both gates 32 and 33 are applied, through lines 34 and 39 respectively, to a combining circuit 35. The combining circuit also receives 4 bit color select signals from a register 36 over lines 40. These color select signals are applied to register 36 from the central processing unit over input lines 37. Combining circuit is controlled by mode signals from mode register over lines 16.

Figure 2:
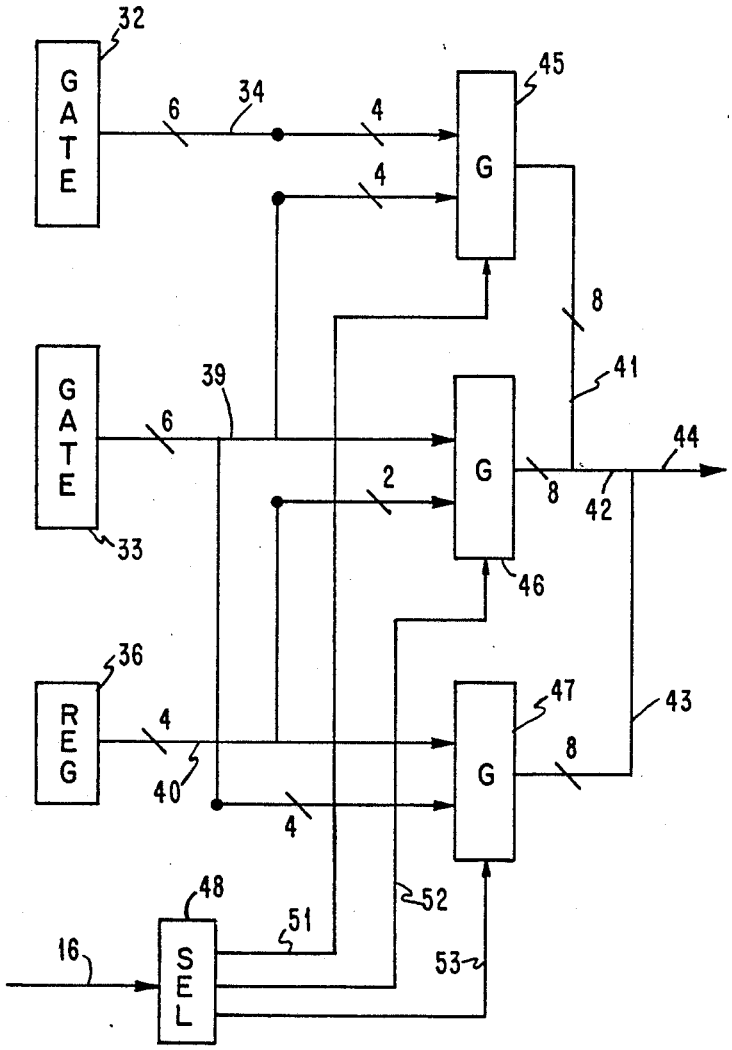
FIG. 2 is a detailed diagram of gates and a combining circuit employed in the FIG. 1 system.

FIG. 2 is a block diagram of an implementation of combining circuit 35. This figure shows the gates 32, 33 and register 36 of FIG. 1 with their six, six and four line outputs 34, 39 and 40 respectively. These lines are selectively coupled to eight bit gates 45, 46 and 47, the eight bit outputs of which are applied through lines 41, 42 and 43 to a common output 44. A selector circuit 48 is responsive to mode input signals from register 38 (FIG. 1) over lines 16 to provide an output selectively on one of its three output lines 51, 52 or 53 thereby enabling one of the gates 45, 46 or 47. When gate 45, is enabled four bits from gate 32 and four bits from gate 33 are passed to output lines 44. When gate 46 is enabled, six bits from gate 33 and two bits from register 36 are applied to output lines 44. When gate 47 is enabled, four bits from gate 33 and four bits from register 36 are applied to output lines 44. These different outputs correspond to three modes of operation of the FIG. 1 system as defined by the mode signals applied to register 38.

Referring back again to FIG. 1, the output of combining circuit 35 on lines 44 is applied to a gate 54. This gate is clocked either at the clock frequency of the signals on clock line 25 from CRTC 14 or at half of that frequency. This half frequency is developed by a latch circuit 55 which is clocked by clock line 25 and has its −Q output coupled back to its D input. The clear input to latch circuit 55 is coupled to a display enable (DISPEN) line, which will be described later.

A selector circuit 56 determines whether the full or half frequency clock rate signals are applied to gate 54 in response to mode signals from mode register 38. As will become more clear later, the half frequency clocking is employed with the output of gate 45 (FIG. 2), that is, with color outputs comprising four bits from each of registers 32 and 33 and the full clocking frequency is used with the other modes of operation of the system.

The eight bit signals passing through gate 54 are employed to drive a color look up table (CLUT) 58. This comprises 256, 18 bit registers selectable by the eight bit input signals. Of the eighteen bits in the registers, six drive a red digital-to-analog circuit 59, a further six, a green digital-to-analog circuit 60 and the last six, a blue digital-to-analog circuit 61 which respectively provide red, green and blue analog output signals to drive a color cathode ray tube display.

As mentioned above, we are at present considering the operation of the system when operating in 640×200 picture elements, 16 color mode. This mode corresponds to selecting register 47 (FIG. 2) to provide outputs to the CLUT 58 at the full clock frequency, i.e. the CRTC clock output is directed unchanged to clock gate 54. In this mode, the color select register 36 provides 4 bits of the CLUT address signals, these remain constant for given periods to define different ranges of colors to be displayed for each of these periods. The remaining 4 bits of the CLUT address come from register 33 and are, therefore determined by the content of the refresh memory planes and the palette system. The clock frequency from CRTC 14 corresponds to the frequency of picture element refreshing on the cathode ray tube, so that each line of picture elements on this tube is displayed in turn. This mode, with four variable bits for each picture element, provides sixteen different colors on the display.

In a further mode, operative when gate 46 in FIG. 2 is selected and again using the full frequency clocking, 640×200 picture elements are again displayed. In this mode, however, there are only two fixed bits from color select register 36 and gate 46 is supplied with all six color bits from gate 33. Accordingly, in this mode, with six variable bits for each picture element, sixty four different colors can be displayed.

In the system as described so far, the refresh memory, parallel to serial shift registers 21 through 24, palette system 31, color look up table 58 and digital to analog circuits 59 through 61 all form parts of known digital display systems.

The present display system is distinguished from those shown in the prior art primarily by the combination of the two gates 32 and 33 in FIG. 1, the gate 45 in FIG. 2 and the mode selectable clock frequency driving gate 54 in FIG. 1. In the present embodiment, all of these items come into play to produce a display with 320×200 picture elements each with a choice of two hundred and fifty six colors.

In the present embodiment the 320×200 picture element mode is the third selectable mode. In this mode, it is gate 45 (FIG. 2) in the combining circuit which is selected and the half clock frequency from latch 55 which is selected by selector 56 to drive gate 54.

When operating in the third mode, the data is read from the refresh store, passed through the parallel to serial shift registers 21 through 24 and gates 26 through 29 at the full clock rate. The gate outputs address the palette register system 31 which applies its six bit outputs to gates 32 from which they pass to gates 33 at the full clock rate. Four bits from each of these gates make up the eight bit output of gate 45 (FIG. 2) which is applied through lines 44 to gate 54. This gate is now operating at a frequency half of the clocking frequency of the circuits up to this point. Accordingly, what passes through this gate to CLUT 58 is each alternate group of eight bits from gate 45, or in other words, in the stream of 6 bit outputs from palette system 31, four bits of each even and four bits of each odd numbered output are combined to form each CLUT input. As there are a full eight variable bits, and no fixed bits from register 36 are used, each group of bits addresses any of the 256 registers in CLUT 58. Accordingly, each displayed picture element can have any one of 256 colors. If the display is scanning at the same frequency, as before, halving the frequency of CLUT addressing from gate 54 means that only half the number of picture elements are formed. Thus, the cathode ray tube will now display 320×200 picture elements, but each element will be selected from 256 colors.

In the above description, the functions and structure of select circuit 17 in FIG. 1 was, for simplicity, omitted. This circuit is a highly desirable, though not essential, part of the display system. It is effective in the low picture element definition mode, described as the third mode above. If we look at the storage requirements of the refresh store, it is clear that, without modification to the system, each displayed pel is generated from two corresponding bits from each of the refresh store planes 10 through 13, In other words, in each plane, each stored byte comprises one quarter of the data for each of four picture elements. Previously, and in the first and second modes of the present system, each stored byte in a plane contained one bit of each of eight picture element data groups. Accordingly, in order to change the data for a single pel, bit manipulation techniques are necessary. These techniques, however, become complex when pairs of bits have to be manipulated.

The select system 17 enables the refresh store to contain bytes in each plane, each byte containing two four bit sets of picture element data. In the first and second modes, the select circuit passes the data from the refresh store without change, and this picture element data is stored as before, with each byte in a plane containing eight bits each representing one bit of different picture element data. In the third mode, the data is stored as bytes, each containing two four bit groups of picture element data. These bytes are read from corresponding locations in consecutive planes. Thus, for example, if the first location to be read out for display is 0, the first byte is read from location 0 in plane 0, the next from location 0 in plane 1 followed by location 0 in plane 2 etc. For both CPU and CRTC accesses to the refresh memory, the two lowest order address bits now define the selected plane, thereby chaining the planes together.

Figure 3:
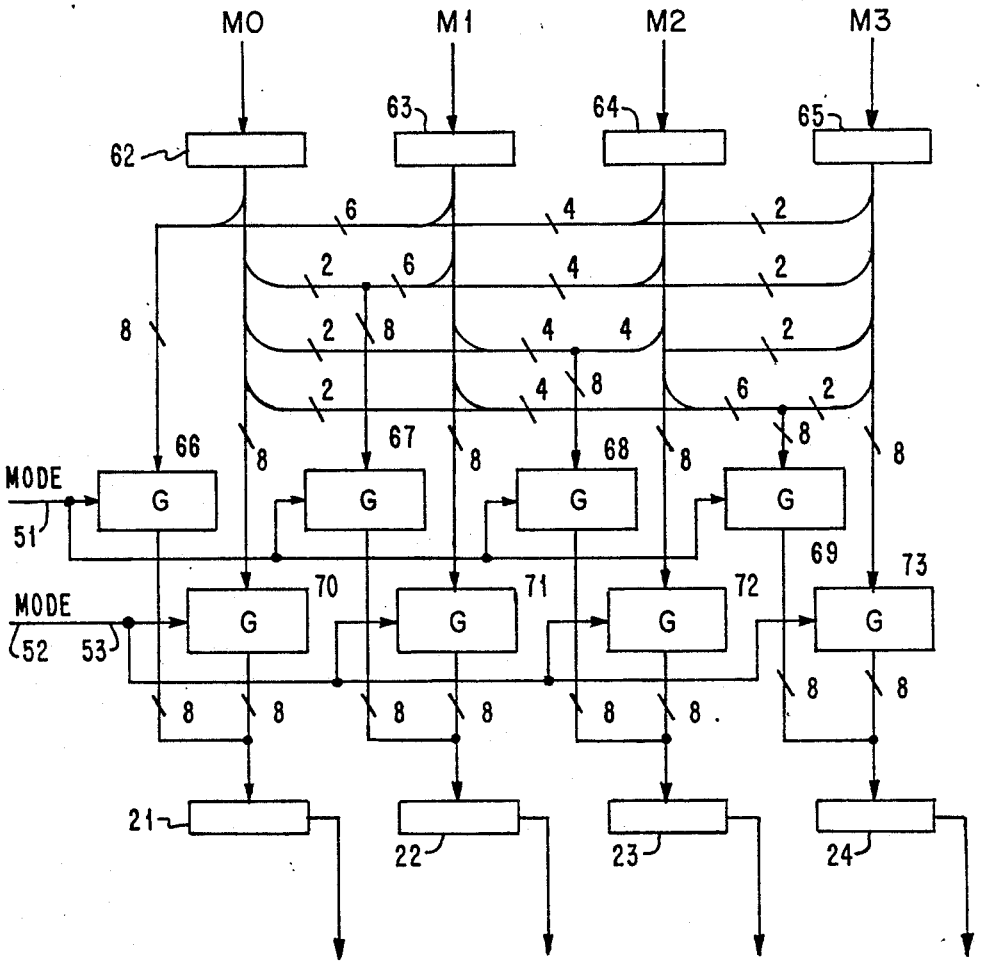
FIG. 3 is a block diagram of a selector circuit employed in the FIG. 1 system.

FIG. 3 shows an embodiment of the select system 17 of FIG. 1. At the top of FIG. 3, four memory data registers 62 through 65 coupled to received data from memory planes M0 through M3 respectively. The data registers are connected through sets of gates 66 through 69 or 70 through 73 to the shift registers 21 through 24. Signals on a mode line 51 (see FIG. 2), which are generated for the 320×200, 256 color display mode, are coupled to gates 66 through 69. Signals which are generated for the other modes (i.e. those generated on lines 52 and 53 in FIG. 2) are used to enable gates 70 through 73. In the high picture element definition modes, i.e. the 640×200 display element modes the signals from registers 62 through 65 are passed through gates 70 through 73 to shift registers 21 through 24 unchanged. In the low picture element definition mode, each gate 66 through 69 passes two bits from each of registers 62 through 65 to each of shift registers 21 through 24. In other words, each shift register receives four groups of two bits, each group from a different memory plane.

Figure 4:
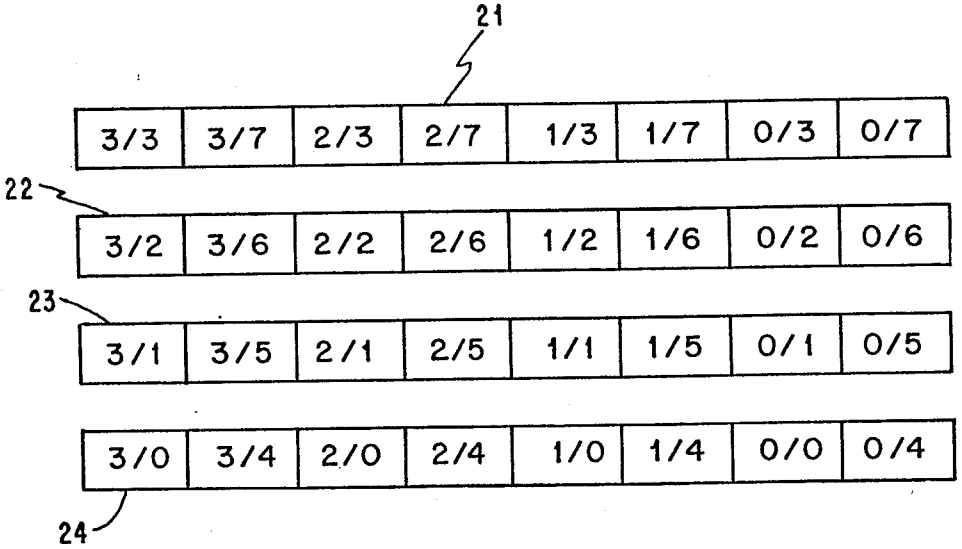
FIG. 4 shows the data content of shift registers used in the FIG. 1 system in one mode of operation thereof.

FIG. 4 shows the bit transfer arrangement. This figure shows the four shift registers 21 through 24 with the serial output lines to the right of each register. In each register stage in FIG. 4 the data content is labeled n/m, where n represents the memory plane and m represents the bit position in a byte read from that plane.

It will be recalled that, in the 320×200 display mode, the color of each picture element is defined by eight bits comprising two consecutive groups of four bits each from the shift registers. Looking at the bit configuration of FIG. 4, it is seen that the first two groups of four bits read from the shift registers comprise a full byte of data from refresh memory plane 0. This byte is followed by bytes from memory planes 1, 2 and then 3. Thus, the refresh store planes may be chained with each byte in a plane representing the data for a complete picture element. As mentioned above, the planes can then have consecutive picture element bytes in sequence whereby they are read out from plane 0 through to plane 3 and then back to plane 0.

In the above description of FIG. 1, it was stated that the DISPEN input to latch 55 on line 57 would be explained. The object of this input is to ensure that, in the 320×200 picture element mode, the correct signals are applied from gates 32 and 33 through combining circuit 35 to CLUT 58. The DISPEN signal is a signal generated by CRTC 14 to indicate the time at which the display is to be enabled. In other words, it defines the portion of each scan line in the display which is modulated by the picture element data. In order to insure that the correct pairs of four bit groups are used, the DISPEN signal holds off latch 55 until the start of the display portion of a scanning line. Then the latch is switched to generate a gating signal through selection 56 to gate 54 on the second full frequency clock cycle, that is when data has been passed through gate 32 to gate 33. Thus, the first picture element in the scanned line is defined by the first two four bit data groups.

In summary, what has been shown is a digital display system for driving a raster scan display device. Picture element data is held in a display store in all points addressable form in which the data layout in the store corresponds with the pel positions on the display device. While the raster scan speed remains the same, the data flow to the display can be set to a first frequency or half that frequency. With the first frequency, a display with high picture element resolution and limited colors is provided. With the half frequency, the picture element resolution is halved, but, by using pairs of groups of successive color signals for each picture element, the color resolution is greatly improved. For efficient refresh store utilization, with the high picture resolution mode, the known system of reading out bytes from multiple storage planes, each byte contain bits relating to one color component of the pels, is used. With the low picture resolution mode, each byte in the refresh store corresponds to a single picture element, and the store planes are chained. A selector circuit between the store and parallel/serial converters coupled to the planes of the store is switched to ensure appropriate data paths between the store and the converters.

While specific values have been used to define the various modes of operation of the system, it is clear that other values could be used, for example 640×200 picture elements, 4 color and 320×200, 16 color, provided that the number of picture elements in one mode is twice the number elements in a second mode. For both modes, the display scan velocity should be the same. In addition, by modifying the system by increasing the number of gates between the palette register 31 and the combining circuit 35, modes in which the number of picture elements in a display may vary by more than twice can be used. For example with three such gates, modes operating at a first frequency, half that frequency, and a quarter of that frequency may be used with corresponding picture element bit definitions. While the invention has been particularly described with reference to a preferred embodiment, it will be understood by those skilled in the art that various other changes in form and detail may be made without departing from the spirit and scope of the invention.

We claim:

1. A digital display system for driving a raster scan display device, said system comprising:

(a) a refresh store for storing picture element data at locations corresponding to locations of associated picture elements on said display device;

(b) means for reading consecutive picture element data from said refresh store to form data groups at a first clock frequency;

(c) means for converting said data groups to picture element drive signal groups for the display device; and (d) switching means for switching said means for converting between a first mode in which each said data group is converted to an individual picture element drive signal group delivered to the display device at said first clock frequency, and a second mode in which each $2^n$ successive data groups are merged together to generate a corresponding individual picture element drive signal group which is delivered to the display device at an n+1 sub harmonic of said first clock frequency, n being a positive integer.

2. A digital display system according to claim 1 in which n is 1 for both the $2^n$ successive data groups and n+1 sub harmonic an said means for converting includes first gating means coupled to receive picture element data groups, second gating means cascadedly coupled to receive the output of said first gating means, said first and second gating means being clocked at said first clock frequency, and combining means coupled to the outputs of both said first and second gating means in said first mode and for merging the outputs of said first and second gating means in said second mode.

3. A digital display system according to claim 2 including third gating means coupled to receive outputs from said combining means, said third gating means being clocked at said first clock frequency in said first mode and at half said first clock frequency in said second mode.

4. A display system according to claim 3 including a color look up table system coupled to receive outputs from said third gating means for generating digital drive signal groups for said display device.

5. A display system according to claim 3 including a palette register system coupled to receive consecutive picture element data groups derived from said refresh store and for generating, in response thereto, said picture element data groups for said first gating means.

6. A display system according to claim 5 in which said refresh memory comprises a plurality of color planes, and including a like plurality of parallel to serial converters, each for receiving data bytes from the memory, and each having a serial output coupled to said palette register system whereby said palette register system receives groups of data having bit widths corresponding in number to the parallel to serial converters.

7. A display system according to claim 6 in which the refresh store comprises four color planes, and including a selector system coupled between the refresh store and the parallel serial converters, said selector system being coupled to said switching means for switching into a first mode in which each byte of data read from a refresh store plane is coupled into the parallel to serial converter associated with the plane, and a second mode in which pairs of bits from each byte read from a storage plane are directed into associated pairs of positions in the parallel to serial converters, whereby each parallel to serial converter receives two bits from each plane of the refresh store.

8. A digital display system for driving a raster scan display device, said system comprising:

(a) a refresh store for storing picture element data at locations corresponding to locations of associated picture elements on said display device;

(b) means for reading consecutive picture element data from said refresh store to form data groups at a first clock frequency; and (c) means for converting said data groups to picture element drive signal groups for the display device including means for merging together each $2^n$ successive data groups to generate a corresponding individual picture element drive signal group which is delivered to the display device at an n+1 sub harmonic of said first clock frequency, n being a positive integer.

9. A digital display system according to claim 8 in which n is 1 for both the $2^n$ successive data groups and n+1 sub harmonic and said means for converting includes first gating means coupled to receive picture element data groups, second gating means cascadedly coupled to receive the output of said first gating means, said first and second gating means being clocked at said first clock frequency, and combining means coupled to the outputs of both said first and second gating means for merging the outputs of said first and second gating means.

10. A display system according to claim 8 wherein the refresh store comprises four color data storage planes; and including a parallel to serial converter for each color plane, and a selector system coupled between the refresh store and the parallel to serial converters, said selector system being coupled to the converting means for directing pairs of bits from each byte read from a storage plane into associated pairs of positions in the parallel to serial converters, whereby each parallel to serial converter receives two bits from each plane to the refresh store.

* * * * *

UNITED STATES PATENT AND TRADEMARK OFFICE

CERTIFICATE OF CORRECTION

PATENT NO. : 4,901,062

DATED : February 13, 1990

INVENTOR(S) : Jeanne E. Morel et al

It is certified that error appears in the above—identified patent and that said Letters Patent is hereby corrected as shown below:

On column 7, line 35, "an" should be --and--.

On column 7, line 41, before "in" should be inserted --for transmitting only the output of said second gating means--.

On column 8, line 59, "to" should be --of--.

Signed and Sealed this

Eighth Day of October, 1991

*Attest:*

HARRY F. MANBECK, JR.

*Attesting Officer*

*Commissioner of Patents and Trademarks*